US006523474B2

(12) United States Patent
Parrott et al.

(10) Patent No.: US 6,523,474 B2
(45) Date of Patent: Feb. 25, 2003

(54) SHAPED RECESSES IN EXPLOSIVE CARRIER HOUSINGS THAT PROVIDE FOR IMPROVED EXPLOSIVE PERFORMANCE

(75) Inventors: Robert A. Parrott, Houston, TX (US); Janet S. Denney, Sugar Land, TX (US); Jack F. Lands, West Columbia, TX (US); Alfredo Fayard, Sugar Land, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 10/197,712

(22) Filed: Jul. 18, 2002

(65) Prior Publication Data

US 2002/0189483 A1 Dec. 19, 2002

Related U.S. Application Data

(62) Division of application No. 09/498,244, filed on Feb. 3, 2000, now Pat. No. 6,460,463.

(51) Int. Cl.[7] ..... F42B 3/02

(52) U.S. Cl. ..... 102/312; 102/309; 102/313; 102/331

(58) Field of Search ..... 102/309, 312, 102/313, 331

(56) References Cited

U.S. PATENT DOCUMENTS

| | | | | | |
|---|---|---|---|---|---|
| 2,639,770 | A | * | 5/1953 | Huber | 102/313 |
| 2,833,213 | A | * | 5/1958 | Udry | 102/313 |
| 4,041,866 | A | | 8/1977 | Thevenin et al. | 102/24 HC |
| 4,109,575 | A | * | 8/1978 | Hashimoto | 102/305 |
| 4,341,983 | A | | 7/1982 | Gottliebson | 318/102 |
| 4,359,943 | A | * | 11/1982 | Majerus | 102/309 |
| 4,365,556 | A | * | 12/1982 | Reibel | 102/307 |
| 4,491,500 | A | | 1/1985 | Michaud et al. | 156/628 |
| 4,498,367 | A | | 2/1985 | Skolnick et al. | 102/476 |
| 4,499,830 | A | | 2/1985 | Majerus et al. | 102/476 |
| 4,702,171 | A | | 10/1987 | Tal et al. | 102/307 |

(List continued on next page.)

FOREIGN PATENT DOCUMENTS

| | | | | |
|---|---|---|---|---|
| EP | 0 105 495 A1 | | 4/1984 | |
| GB | 707380 | * | 4/1954 | 102/331 |
| GB | 832685 | | 4/1960 | |
| GB | 854043 | | 11/1960 | |
| GB | 1 504 431 | | 2/1978 | |
| GB | 2 303 687 A | | 2/1997 | |
| GB | 2 326 220 A | | 12/1998 | |

OTHER PUBLICATIONS

Walters et al., "Fundamentals of Shaped Charges," pp. 339–351 (John Wiley & Sons, 1989).

Delacour et al., "A New Approach to Elimination of Slug in Shaped Charge Perforating," Paper No. 941–G, pp. 1–10 (1957).

*Primary Examiner*—Peter A. Nelson
(74) *Attorney, Agent, or Firm*—Jeffrey E. Griffin; Brigitte L. Jeffery; John J. Ryberg

(57) ABSTRACT

A carrier for containing explosives (e.g., shaped charges) includes a housing having a plurality of recesses, each recess having a periphery and a side surface extending around the periphery. The side surface is shaped to a geometry to reduce or control reflection of compression waves generated in response to an explosive jet (e.g., a perforating jet) created due to detonation of an explosive. The side surface may be slanted from a bottom surface of the recess, or a predetermined profile may be formed in the side surface to scatter or direct compression waves. One or more shock absorbing inserts may also be placed in recesses formed by the inserts, or the recesses may be capped to trap air so that compression waves generated in the recesses are significantly reduced as compared to compression waves generated in well fluids.

24 Claims, 12 Drawing Sheets

U.S. PATENT DOCUMENTS

| | | | | | |
|---|---|---|---|---|---|
| 4,739,709 | A | * | 4/1988 | Zimmerschied | 102/309 |
| 4,766,813 | A | | 8/1988 | Winter et al. | 156/628 |
| 4,818,333 | A | | 4/1989 | Michaud | 102/476 |
| 4,951,744 | A | * | 8/1990 | Rytlewski | 102/313 |
| 4,958,569 | A | | 9/1990 | Mandigo | 102/307 |
| 5,090,324 | A | | 2/1992 | Böcker et al. | 102/307 |
| 5,259,317 | A | | 11/1993 | Lips | 102/310 |
| 5,322,019 | A | * | 6/1994 | Hyland | 102/312 |
| 5,619,008 | A | | 4/1997 | Chawla et al. | 102/310 |
| 5,862,758 | A | * | 1/1999 | Parrott | 102/312 |
| 6,021,714 | A | | 2/2000 | Grove et al. | 102/307 |

* cited by examiner

SHAPED RECESSES IN EXPLOSIVE CARRIER HOUSINGS THAT PROVIDE FOR IMPROVED EXPLOSIVE PERFORMANCE

CROSS REFERENCE TO RELATED APPLICATION

This is a divisional of U.S. Ser. No. 09/498,244, filed Feb. 3, 2000, now U.S. Pat. No. 6,460,463

BACKGROUND

The invention is generally related to recesses in explosive carrier housings (such as perforating gun carrier housings) that provide for improved explosive performance (such as improved performance perforating shaped charges).

After a well has been drilled and casing has been cemented in the well, perforations are created to allow communication of fluids between reservoirs in the formation and the wellbore. Shaped charge perforating is commonly used, in which shaped charges are mounted in perforating guns that are conveyed into the well on a slickline, wireline, tubing, or another type of carrier. The perforating guns are then fired to create openings in the casing and to extend perforations into the formation.

Various types of perforating guns exist. A first type is a strip gun that includes a strip carrier on which capsule shaped charges may be mounted. The capsule shaped charges are contained in sealed capsules to protect the shaped charges from the well environment. Another type of gun is a sealed hollow carrier gun, which includes a hollow carrier in which non-capsule shaped charges may be mounted. The shaped charges may be mounted on a loading tube or a strip inside the hollow carrier. Thinned areas (referred to as recesses) may be formed in the wall of the hollow carrier housing to allow easier penetration by perforating jets from fired shaped charges. Another type of gun is a sealed hollow carrier shot-by-shot gun, which includes a plurality of hollow carrier gun segments in each of which one non-capsule shaped charge may be mounted.

Another type of gun is a puncher gun, designed to perforate the interior tubing, casing, drillpipe or similar wellbore lining while leaving the exterior tubing, casing, drillpipe, drill collar or similar wellbore lining intact. Another type of gun is a cutter designed to perforate the tubing, casing, drillpipe, drill collar or similar wellbore lining in a pattern which will allow removal of same without damage to the formation or other wellbore structures.

Referring to FIGS. 1A–1C, an example of a conventional perforating gun 10 including a hollow carrier 12 is illustrated. The hollow carrier 12 contains plural shaped charges 20 that are attached to a strip 22. Alternatively, the shaped charges 20 may be attached to a loading tube inside the hollow carrier 12. In the illustrated arrangement, the shaped charges 20 are arranged in a phased pattern. Non-phased arrangements may also be provided.

The hollow carrier 12 has a housing that includes recesses 14 that have generally circular recesses, as illustrated in FIG. 1A. The recesses 14 are designed to line up with corresponding shaped charges 20 so that the perforating jet exits through the recess to provide a low resistance path for the perforating jet. This enhances performance of the jet to create openings in the surrounding casing as well as to extend perforations into the formation behind the casing.

As shown in the cross-sectional view of FIG. 1B and the longitudinal sectional view of FIG. 1C, each recess 14 includes a bottom surface 18 and a side surface 16. A web 19 (which is a thinned region of the carrier housing 12) is formed below the recess 14. The side surface 16 and the bottom surface 18 are generally perpendicular to each other. The bottom surface 18 and side surface 16 define a generally cylindrical geometry in the recess 14. As will be described below, the generally perpendicular side surface 16 of a typical recess 14 causes reflection of compression waves that interfere with the perforating jet (from a fired shaped charge) as it extends through the recess 14. For big hole charges, this reduces the opening in the casing created by the perforating jet. For deep penetrating charges, the depth of penetration may be reduced.

Referring to FIGS. 2A–2B, a generally conical shaped charge 20 includes an outer case 32 that acts as a containment vessel designed to hold the detonation force of the detonating explosive long enough for a perforating jet to form. The generally conical shaped charge 20 is a deep penetrator charge that provides relatively deep penetration.

Another type of shaped charge includes substantially non-conical shaped charges (such as pseudo-hemispherical, parabolic, or tulip-shaped charges). The substantially non-conical shaped charges are big hole charges that are designed to create large entrance holes in casing. Another type of shaped charge is a puncher charge, which is a specialized version of a big hole charge designed to create large hole with a specific, short range of penetration.

The conical shaped charge 20 illustrated in FIG. 2A includes a main explosive 36 that is contained inside the outer case 32 and is sandwiched between the inner wall of the outer case 32 and the outer surface of a liner 40 that has generally a conical shape. A primer 34 provides the detonating link between a detonating cord (not shown) and the main explosive 36. The primer 34 is initiated by the detonating cord, which in turn initiates detonation of the main explosive 36 to create a detonation wave that sweeps through the shaped charge 20. As shown in FIG. 2B, upon detonation, the liner 40 (original liner 40 represented with dashed lines) collapses under the detonation force of the main explosive 36. Material from the collapsed liner 40 flows along streams (such as those indicated as 49) to form a perforating jet 46 along a J axis.

The tip of the perforating jet travels at speeds of approximately 25,000 feet per second and produces impact pressures in the millions of pounds per square inch. The tip portion is the first to penetrate the web 19 below the recess 14 in the housing 12 of the gun carrier. The perforating jet tip then penetrates the wellbore fluid immediately in front of the web and inside the geometry of the recess 14. At the velocity and impact pressures generated by the jet tip, the wellbore fluid is compressed out and away from the tip of the jet. However, due to confinement of the wellbore fluid by the substantially perpendicular side surface 16 of the recess 14, the expansion, compression, and movement of the wellbore fluid is limited and the wellbore fluid may quickly be reflected back upon the jet at a later portion of the jet (behind the tip).

As the perforating jet passes through the recess 14 (FIGS. 1B and 1C), a compression wave front is created by the perforating jet in the fluid that is located in the recess. When the compression wave impacts the side surface 16, a large portion of the compression wave is reflected back towards the perforating jet, which carries the wellbore fluid back to the jet. The reflected wellbore fluid interferes with the perforating jet. The effect is more pronounced in a relatively deep recess with a perpendicular side surface (such as side surface 16), or if the clearance between the gun carrier and the casing is limited (that is, the gun carrier is close to the casing). When the clearance between the gun carrier and the casing is limited, interactions between the reflected compression wave off the inside surface of the wellbore casing and the reflected compression wave off the side surface 16 of the recess 14 also combine to impede the free passage of the shaped charge jet through the wellbore fluid. The resultant interference with the perforating jet may reduce the depth of penetration (for deep penetrating charges) or the size of the casing entrance hole (for big hole charges).

In addition to the desire to improve performance of the perforating jet, the recess formed in a gun carrier housing should also account for other factors. As shown in FIGS. 1B and 1C, the recess 14 is formed below the outer surface of the carrier housing 12. As the shaped charge perforating jet passes through the web 19 of the carrier housing 12, an exit burr may be created that protrudes towards the outside of the carrier housing. However, by having recesses (and webs below the recesses) for the jets to pass through, the exit burr is kept below the external surface of the wall of the carrier housing. In this way, the sharp and hard exit burr is kept from touching and scratching the inside surface of the wellbore casing or other components in the wellbore to prevent damage to such components as the gun is being retrieved to the surface.

In forming the recesses, the recesses are made relatively deep to reduce the resistance path for a perforating jet, but not so deep that the carrier housing is unable to support the external wellbore pressures experienced by the gun carrier. The size of the recesses are also optimized to ensure that jets pass through the recesses and not through the carrier housing around the recesses. However, the sizes of the recesses are limited to enhance the structural integrity of the carrier housing in withstanding external wellbore pressures and internal forces created by detonation of the shaped charges.

The generally cylindrical geometries of some conventional recesses provide for relatively reliable carrier housing integrity. However, as explained above, such a geometry causes interference that may adversely affect the performance of the perforating jets. Other types of recess geometries are also available. For example, some may have generally elliptical shapes. However, such recess geometries may come at the expense of carrier housing integrity, since the recesses may take up too much surface area of the carrier housing, or remove too much carrier housing material.

A need thus continues to exist for improved recesses in gun or other explosive carrier housings that improve performance of shaped charges or other explosives without sacrificing integrity of the carrier housing.

SUMMARY

In general, according to one embodiment, a carrier for containing explosives includes a housing having a plurality of recesses, each recess having a periphery and a side surface extending around the periphery and shaped to control the reflection of compression waves generated in response to an explosive jet created due to detonation of an explosive.

Other embodiments and features will become apparent from the following description, from the drawings, and from the claims.

DETAILED DESCRIPTION

Figure 1A:
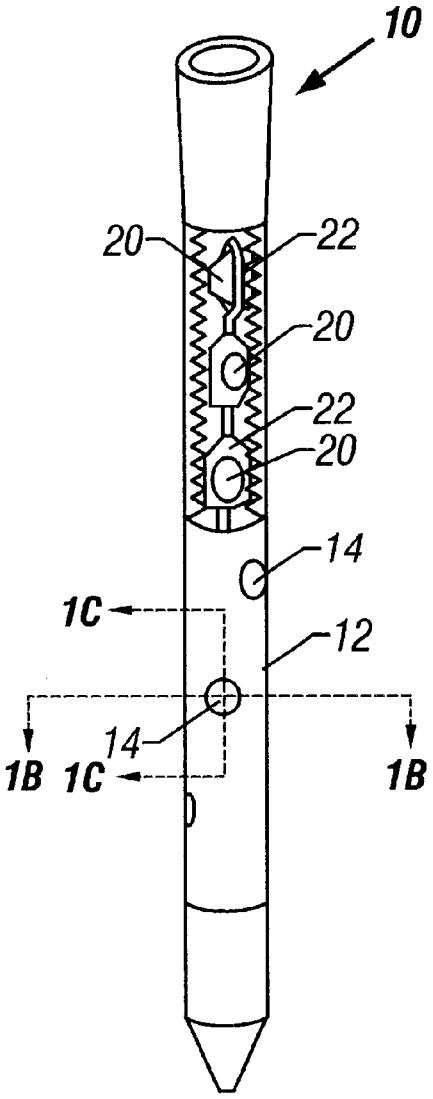
FIG. 1A (Prior Art)
FIGS. 1A–1C illustrate a conventional perforating gun that includes a hollow carrier having plural recesses.

In the following description, numerous details are set forth to provide an understanding of the present invention. However, it will be understood by those skilled in the art that the present invention may be practiced without these details and that numerous variations or modifications from the described embodiments may be possible. For example, although the described embodiments include recesses used with perforating gun carriers containing shaped charges, other embodiments may include carriers for other types of explosives.

As used here, the terms "up" and "down"; "upper" and "lower"; "upwardly" and downwardly"; "below" and "above"; and other like terms indicating relative positions above or below a given point or element are used in this description to more clearly describe some embodiments of the invention. However, when applied to equipment and methods for use in wells that are deviated or horizontal, or when applied to equipment and methods that when arranged in a well are in a deviated or horizontal orientation, such terms may refer to a left to right, right to left, or other relationships as appropriate.

In accordance with some embodiments of the invention, recesses formed in the outer wall of a carrier housing are shaped to enhance the performance of shaped charges (or other types of explosives). As used here, "recess" refers generally to any type of thinned region or portion of an explosive carrier housing to allow easier penetration of a jet due to detonation of the explosive. Such recesses may have any of various different shapes. A recess may be bounded by one or more side surfaces and, optionally, by a bottom surface and/or a top surface. Without the bottom or top surfaces, the recess would generally be a hole. The recesses are shaped to reduce or control the reflectivity of compression waves from the side surfaces of the recesses. The geometry of the recess is formed to control the interaction of the wellbore fluid with the passage of the shaped charge jet to improve performance of the shaped charge. While providing for reduced interference with perforating jets, the recesses are also designed to maintain collapse resistance from external pressure and burst resistance from internal detonation pressures. By reducing interference of the perforating jet, casing entrance holes (for big hole charges) and penetration depths (for deep penetrator charges) may be enhanced.

The shaped recesses in accordance with some embodiments accomplish the objective of enhancing performance of shaped charges by controlling, disrupting, or tailoring reflected pressures or compression waves in wellbore fluids that are induced by an early portion of a perforating jet (the tip of the jet). The reflected pressure or compression waves are generally deflected out of the path of the later portion of the perforating jet. The geometric profile of the shaped recess may be varied to focus or diffuse the reflections, depending on the desired performance. Depending on the type of shaped charge, the interest may be nearer the early portion of the jet for a big hole type charges or along any portion of the jet for deep penetrators.

The geometry of the recess in accordance with some embodiments may be shaped to one of several different profiles or arrangements. Rather than the cylindrical recess with a generally perpendicular side surface as provided by some conventional recesses, the shaped recess in accordance with some embodiments may include a slanted side or peripheral surface at some angle with respect to the bottom surface of the recess. The slanted side surface may have a flat (or planar) cross-section or a concave or convex cross-section. The side surface may also have a profile, such as a stepped, grooved, or other profile, adapted to scatter, focus or otherwise control reflected compression waves. The diameter of the bottom surface, the depth of the recess (with respect to the outer surface of the carrier housing), and the shape and orientation of the side surface may be selected to optimize shaped charge performance, collapse resistance from external pressure, and burst resistance from internal detonation pressures.

Figure 3:
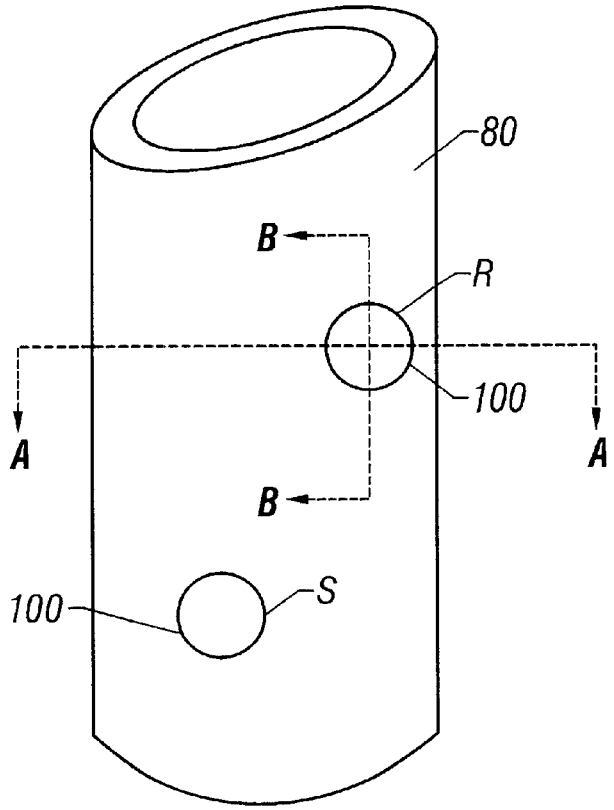
FIG. 3 illustrates a portion of a gun carrier housing having a plurality of recesses in accordance with one embodiment.

Referring to FIG. 3, a portion of a gun carrier housing 80 is illustrated. The gun carrier housing 80 includes a plurality of recesses R that have one of various shaped geometries. The gun carrier housing 80 may be part of a perforating gun that is similar to that shown in FIG. 1A. In FIG. 3, a transverse or cross-section of the carrier housing 80 is represented by line A—A, and a longitudinal section of the carrier housing 80 is represented by line B—B.

Figure 4A:
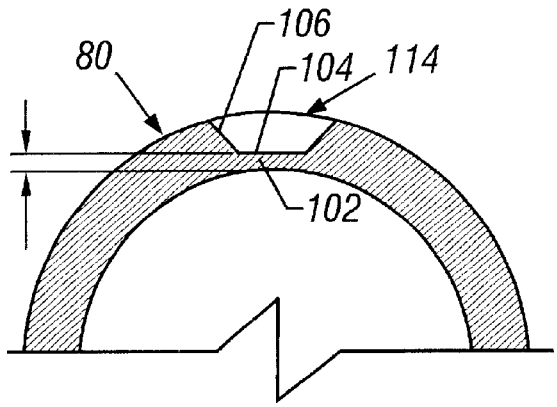
FIGS. 4A–4B, 5A–5B, 6A–6B, 7A–7B, 8A–8B, 9A–9B, 10A–10B, 11, 12A–12B and 13 illustrate different embodiments of recesses useable with the gun carrier of FIG. 3.
Figure 4B:
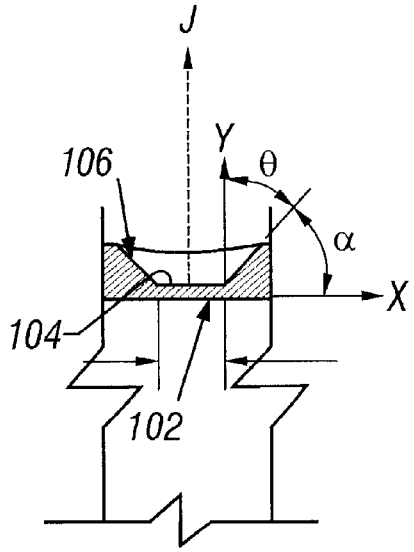

Referring to FIGS. 4A–4B, a recess 114 in accordance with one embodiment may be formed in the gun carrier housing 80 (FIG. 3). FIG. 4A is the cross-section of the carrier housing 80 in accordance with one embodiment taken along line A—A, and FIG. 4B is the longitudinal section of the carrier housing 80 taken along line B—B. As shown in FIG. 3, each recess has a periphery 100 that when viewed from the top is generally circular in shape. In further embodiments, the periphery 100 of the recess may have other shapes, such as rectangular, square, triangular, elliptical, and other shapes. As shown in FIGS. 4A–4B, the recess 114 has a generally flat bottom surface 104 and a side surface 106. The side surface 106 extends around the periphery of the recess 114. As used here, a side surface that extends around the periphery of the recess refers to the presence of a wall segment of some depth around each point of the periphery.

With a generally circular or elliptical recess, the side surface 106 is continuous around the periphery of the recess 114. However, if the recess has another shape, such as triangular, square, or rectangular, the side surface 106 would be divided into multiple segments corresponding to the segments of the triangle, square, or rectangle.

In the illustrated embodiment, at each point along the periphery of the recess 114, the side surface 106 extends at a predetermined angle from the bottom surface 104. The side surface 106 widens as its extends from the bottom surface 104 in a generally cone-like manner. Thus, a cup-shaped geometry is provided by the recess 114.

As shown in FIG. 4B, two axes X and Y may be defined. The axis Y is generally perpendicular to the bottom surface 104, while the X axis extends in the plane of the bottom surface 104. The angle of the side surface 106 from the axis Y is defined as $\theta$, and the angle of the side surface 106 from the X axis is defined as $\alpha$. In the illustrated embodiment of FIG. 3B, both $\alpha$ and $\alpha$ are 45°. In further embodiments, the angles $\theta$ and $\alpha$ may be varied to provide the desired performance of the perforating jet. Generally, the angle $\alpha$ may range between an angle greater than 0° but less than 90°. A more specific range is between about 10° and 80°.

The slanted side surface 106 that angles away from the bottom surface 104 reduces, disrupts, or re-directs reflection of compression waves from the side surface 106 to reduce interference with a perforating jet that extends generally along an axis indicated as J, which is generally perpendicular to the bottom surface 104. The side surface 106 thus slants away from the axis J. Slanting of the side surface 106 relieves a substantial part of compression waves generated by the leading part of the perforating jet. Also, the slanted side surface 106 increases the time needed for compression waves to travel from the perforating jet J to the side surface 106 and back to the perforating jet J.

Consequently, by relieving the reflected compression waves and increasing the travel time for incident and reflected compression waves to the recess side surface, a smaller amount of well fluid is reflected into the path of the perforating jet during the critical time period to reduce interference with the jet.

Thus, generally, the recess 14 according to FIGS. 4A–4B has an axis (generally parallel to axis J), and the recess is bounded by a surface at least a portion of which is planar and lies at an angle to the axis.

Figure 5A:
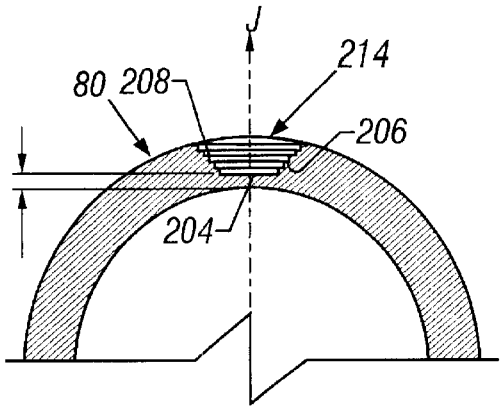
Figure 5B:
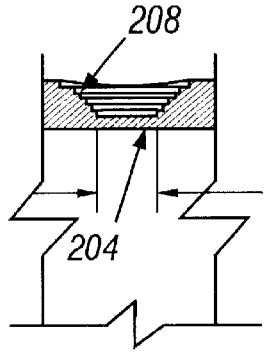

Referring to FIGS. 5A–5B, a recess 214 in accordance with an alternative embodiment of is illustrated. As with the recess 114 shown in FIGS. 4A–4B, the side surface 206 of the recess 214 is slanted away from the bottom surface 204 of the recess 214. However, in addition to the angling of the side surface 206, the side surface 206 is also roughened or otherwise provided with a predetermined profile to aid in further disruption of reflection of compression waves. For example, steps 208 may be formed in the side surface 206 as illustrated in FIGS. 5A–5B. Other types of profiles may be formed on the side surface 206 in other embodiments. For example, grooves or slots may also be machined into the side surface 206 to roughen the surface. Alternatively, a more random pattern may also be formed in the side surface 206 to roughen it.

In another embodiment, effective disruption of reflected compression waves may also be achievable by forming a profile on a side surface that is generally perpendicular to the bottom surface of a recess, such as with conventional recesses. Thus, a modification of the recess 214 would be to provide the side surface 206 at an angle of about 90° to the bottom surface 204 while forming some predetermined profile in the side surface.

Figure 6A:
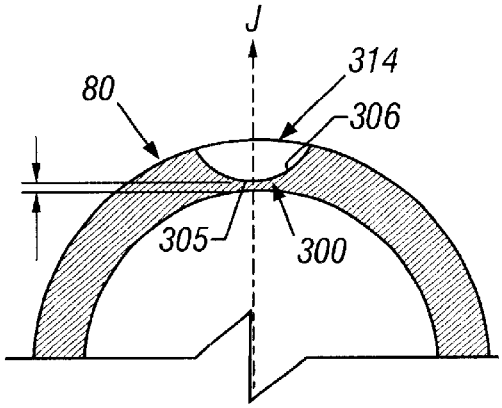
Figure 6B:
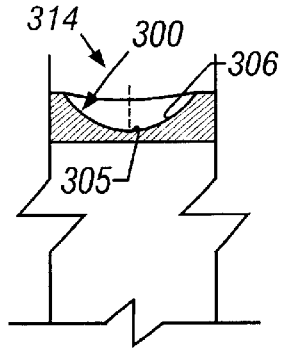

Referring to FIGS. 6A–6B, a recess 314 in accordance with another embodiment is illustrated. The recess 314 does not have discrete bottom and side surfaces as in the embodiments of FIGS. 4A–4B and 5A–5B. Instead, the recess 314 has a generally arcuate or curvilinear surface 300 that extends around the periphery of the recess 314. The arcuate surface 300 of the recess 314 as shown in FIGS. 6A–6B is generally semi-hemispherical in shape and has a bottom surface portion 305 that is continuous with a side surface portion 306 along an arc (as shown in the sectional views). The side surface 300 is thus curvilinear in a direction from the bottom surface portion 305 to the upper edge or top of the recess about the full periphery of the recess 314. The side surface portion 306 of the surface 300 extends away from the axis J (along which the perforating jet extends) at some predetermined relationship defined by the arcuate surface 300. Again, the relationship of the side surface portion 306 and the axis J is such that compression waves generated by the perforating jet extending along the axis J are less effectively reflected back into the path of the perforating jet.

Figure 7A:
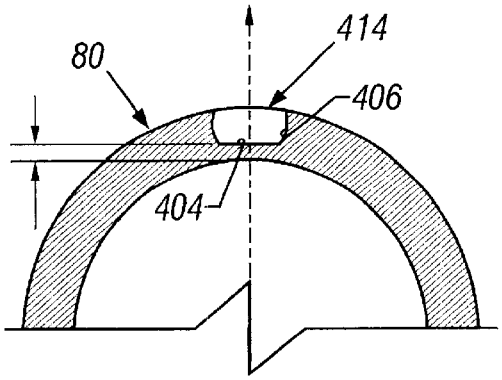
Figure 7B:
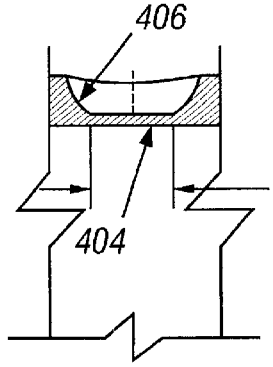
Figure 8A:
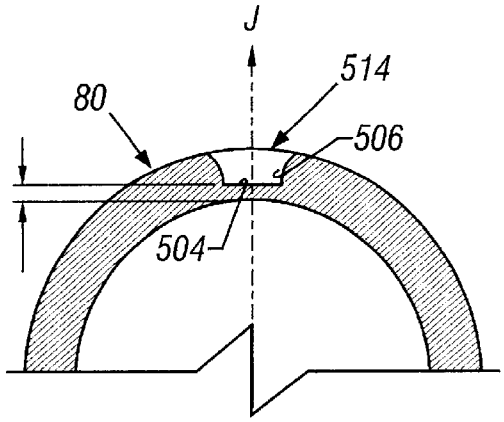
Figure 8B:
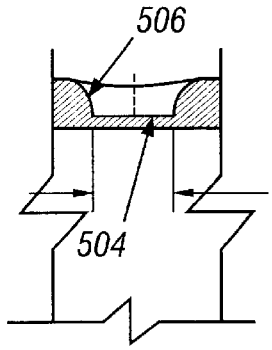

Referring to FIGS. 7A–7B, a recess 414 according to another embodiment has a bottom surface 404 and a side surface 406 that is generally concave in shape. Referring to FIGS. 8A–8B, another embodiment of a recess 514 includes a bottom surface 504 and a side surface 506 that is generally convex in shape. The concave side surface 406 and the convex side surface 506 of recesses 414 and 514, respectively, are shown extending away from the axis J along which a perforating jet generally travels. Again, both side surfaces 406 and 506 are curvilinear from the bottoms of respective recesses 414 and 514 to the tops of the recesses.

Figure 9A:
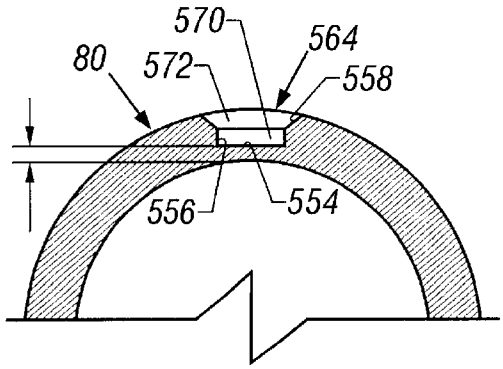
Figure 9B:
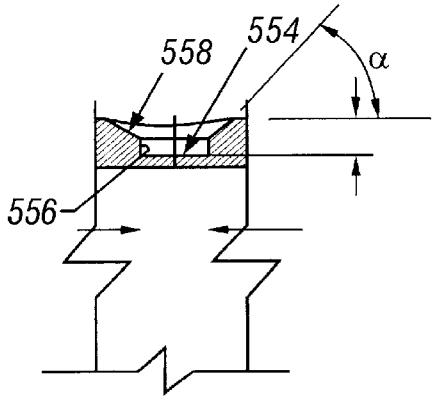

Referring to FIGS. 9A–9B, a recess 564 in accordance with a further embodiment includes a lower portion 570 and an upper portion 572. The lower portion 570 has a bottom surface 554 and a generally perpendicular side surface 556. In the second portion 572, a slanted side surface 558 is slanted outwardly with respect to the side surface 556. The lower portion 570 is generally cylindrical in shape, while the upper portion 572 generally forms part of a cone. The recess 564 is thus generally a combination of a conventional recess and the recess according to FIGS. 4A–4B.

Thus, the embodiments as described in FIGS. 4A–4B, 5A–5B, 6A–6B, 7A–7B, 8A–8B, and 9A–9B, as well as other embodiments as described herein, may generally include a carrier with a housing having recesses each with an axis (generally parallel to axis J). Each recess is defined by a side surface, with the distance from the axis to the side surface varying from a bottom of the recess to a top of the recess about the full periphery of the recess.

Described generally in another way, some embodiments may include a carrier having a housing with recesses each having an axis. The recess is defined by a side surface and has a first aspect dimension and a second aspect dimension. The first aspect dimension equals the distance from one surface to an opposite surface and measured along a line passing through and perpendicular to the axis. The second aspect dimension equals the distance from one surface to an opposite surface and measured along a line passing through and perpendicular to the axis and perpendicular to the first aspect dimension. The first and second aspect dimensions vary from a bottom of the recess to a top of the recess.

Figure 10A:
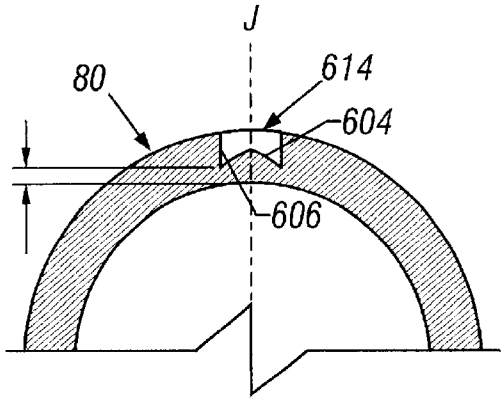
Figure 10B:
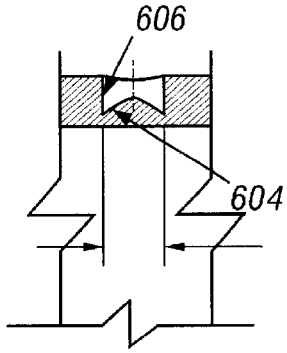

Referring to FIGS. 10A–10B, in another embodiment, a recess 614 includes a convex-shaped bottom surface 604 and a generally perpendicular side surface 606 that is generally parallel to the axis J. A modification of the recess 614 would include a concave instead of a convex-shaped bottom surface 604. Another modification of the recess 614 would include a slanted side surface 606.

Figure 11:
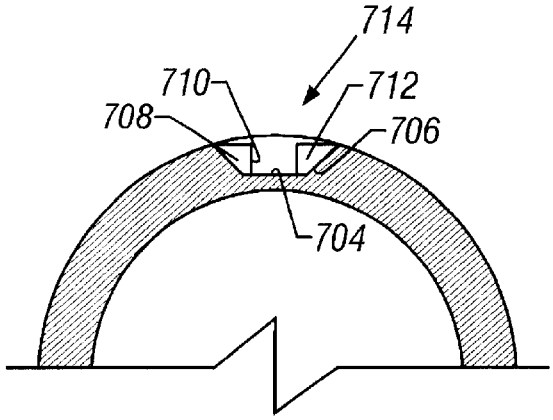

Referring to FIG. 11, a recess 714 according to yet a further embodiment includes a bottom surface 704 and a slanted side surface 706 that has a predetermined angle less than 90° with respect to the axis X in the plane of the bottom surface 704. In addition to that arrangement, the recess 714 includes an insert 708 (generally ring-shaped) arranged around the side surface 706. The insert 708 may be formed of a shock absorbing material to reduce or disrupt the reflection of compression waves. The insert alternately may be used to tailor the reflections to focus on the jet. Alternatively, instead of a separate insert, the side surface of the recess may be coated with a shock absorbing material. Example shock absorbing materials include aluminum, ceramic, plastic, powdered metal, foam, or other like materials. The insert 708 may have various shapes, with a vertical inner surface 710 and slanted outer surface 712 shown in FIG. 11. Other configurations of the insert 708 may be used with recesses having a generally perpendicular side surface as in conventional recesses.

Figure 12A:
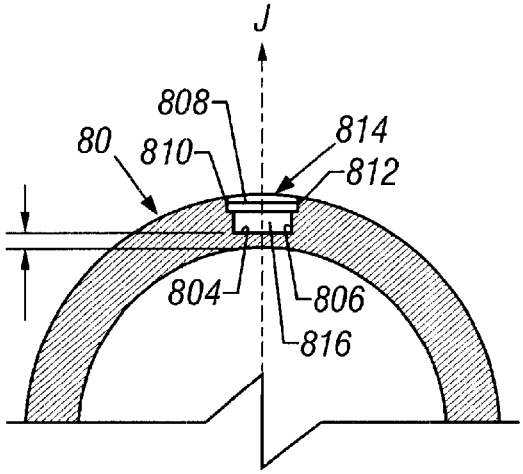
Figure 12B:
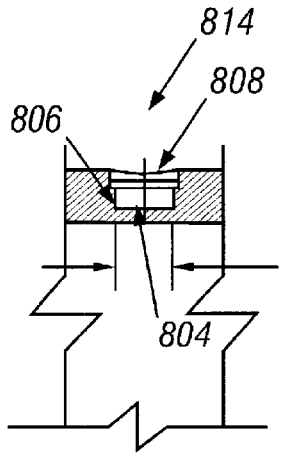

Referring to FIGS. 12A–12B, in accordance with another embodiment, a recess 814 includes a bottom surface 804 and a side surface 806 that is generally perpendicular to the bottom surface 804 (as in conventional recesses). However, a cap 808 is provided in the recess 814, with the cap sitting on a shoulder 810 provided by the carrier housing 80. A pressure tight seal 812, which may be formed of an elastomer material or by welding, for example, is positioned around the outside and/or outside bottom of the cap 808 to provide a seal so that a sealed chamber 816 is defined in the recess 814. Since the assembly is assembled at the surface, the chamber 816 may be filled with air. Other types of gases or fluids may be provided in the chamber 816. The cap 808 may be made of metal, ceramic or other like material that can withstand the outside well pressures but at the same time is easily shattered by a perforating jet traveling through the recess 814.

When a perforating jet passes through the recess 814, compression waves generated in the air chamber 816 are significantly reduced as compared to compression waves generated in fluids in a wellbore that may be outside the gun carrier housing 80. As a result, interference with the perforating jet inside the recess 814 (the chamber 816) is significantly reduced. In modifications or variations of the arrangement of FIGS. 12A–12B, the side surface 806 may be slanted with respect to the bottom surface 804. In addition, the side surface 806 may have a concave or convex shape. Further, an arcuate surface, such as the surface 300 shown in FIGS. 6A–6B, may also be used.

Figure 13:
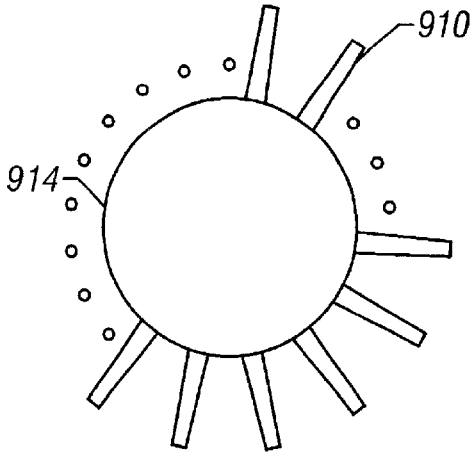

Referring to FIG. 13, a top view of a recess 914 in accordance with another embodiment is illustrated. The recess 914 may be shaped as a conventional recess or as any one of the recesses shown in FIGS. 4A–4B, 5A–5B, 6A–6B, 7A–7B, 8A–8B, 9A–9B or 10A–10B. In addition, slots 910 are extended away from the recess 914. The slots 910 provide a travel path for compression waves so that only a portion of incident compression waves are reflected back to the path of the perforating jet. The slots 910 thus provide a mechanism to disrupt reflection of compression waves generated by a perforating jet.

The table below summarizes test results performed using big-hole charges fired through conventional recesses according to FIGS. 1B–1C and recesses according to FIGS. 4A–4B.

| Clearance | EH AVG .75 × 0° | EH AVG 1.00 × 45° |
|---|---|---|
| 0.62 | 0.77 | 0.82 |
| 0.69 | 0.74 | 0.89 |

-continued

| Clearance | EH AVG .75 × 0° | EH AVG 1.00 × 45° |
|---|---|---|
| 0.84 | 0.73 | 0.83 |
| 0.92 | 0.71 | 0.79 |
| Average | 0.736 | 0.839 |

The table includes 3 columns, with the first column indicating the water filled clearance distance between the gun carrier and the casing (in inches). The second column includes the average entrance hole size created using a big hole charge fired through a conventional recess according to FIGS. 1B–1C with a diameter of about 0.75 inches and a side surface that is generally perpendicular to the bottom surface of the recess (represented as the angle θ of about 0°). The third column includes the size of entrance holes created in the casing using the same types of big-hole charges fired through a recess according to FIGS. 4A–4B having a diameter of about 1.00 inches and a slanted side surface 106 having an angle θ of about 45°.

Thus, as shown by the table of results, the shaped charge performance with recesses according to the FIGS. 4A–4B embodiment is superior to the performance with conventional recesses.

Figure 14:
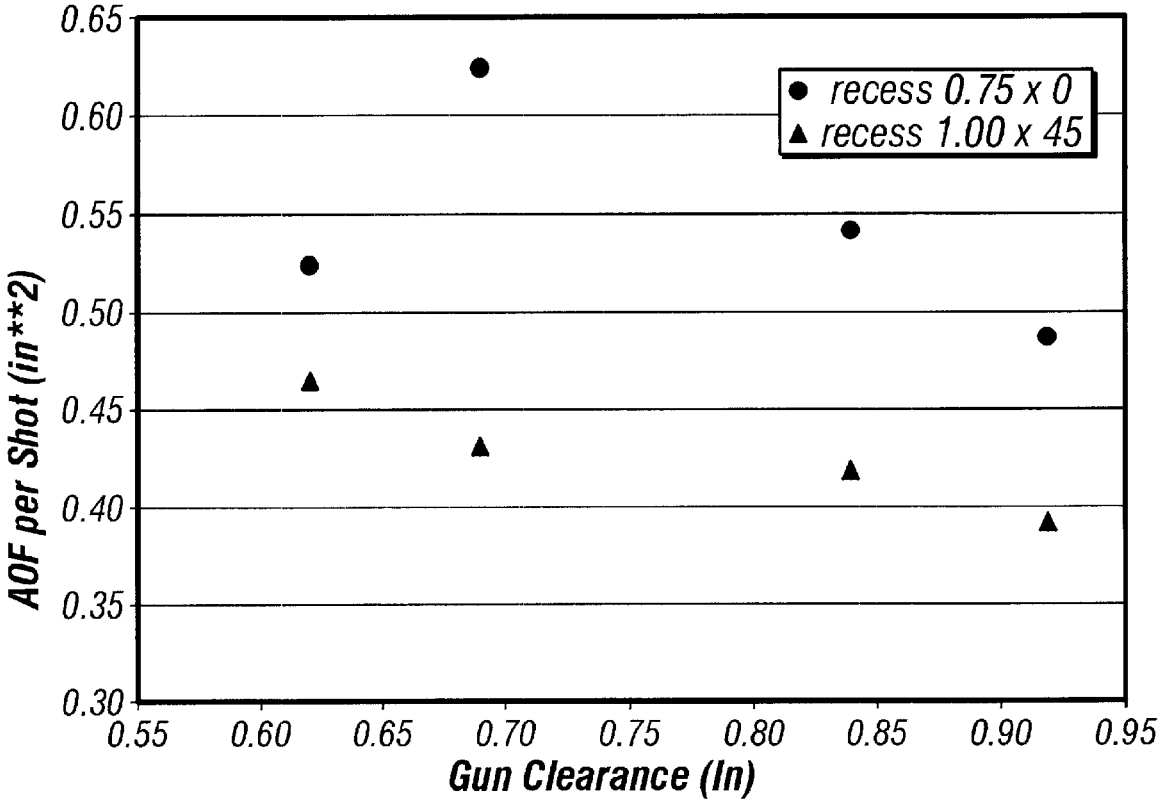
FIG. 14 is a chart of test results comparing the performance obtained with recesses of prior art FIGS. 1B–1C and recesses of the invention FIGS. 4A–4B.

Referring to FIG. 14, a chart illustrating the area open to flow created by the casing opening per shot versus the gun clearance is illustrated. The triangular dots represent the results obtained with conventional recesses (0.75 inches and angle θ of about 0°). The circular dots represent results obtained using recesses according to FIGS. 4A–4B having a diameter of about 1.0 inch and an angle θ of about 45°. As illustrated, the average area open to flow per shot obtained with a recess according to FIGS. 4A–4B at any given clearance is superior to those obtained with conventional recesses.

Figure 1B:
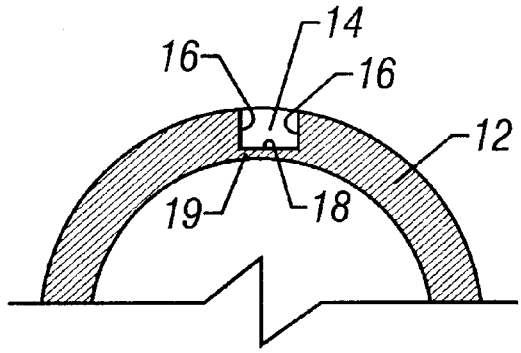
FIG. 1B (Prior Art)
Figure 1C:
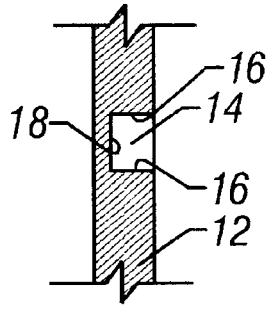
FIG. 1C (Prior Art)
Figure 2A:
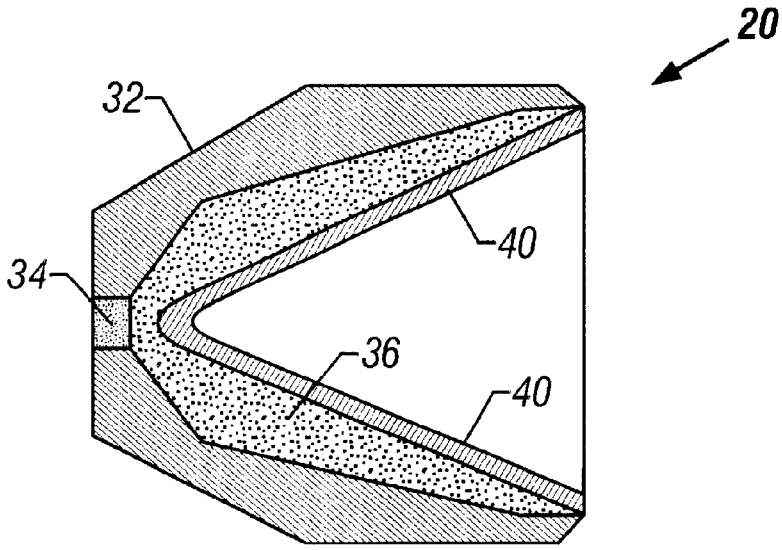
FIG. 2A (Prior Art)
FIGS. 2A–2B illustrate formation of a perforating jet by a conventional shaped charge.
Figure 2B:
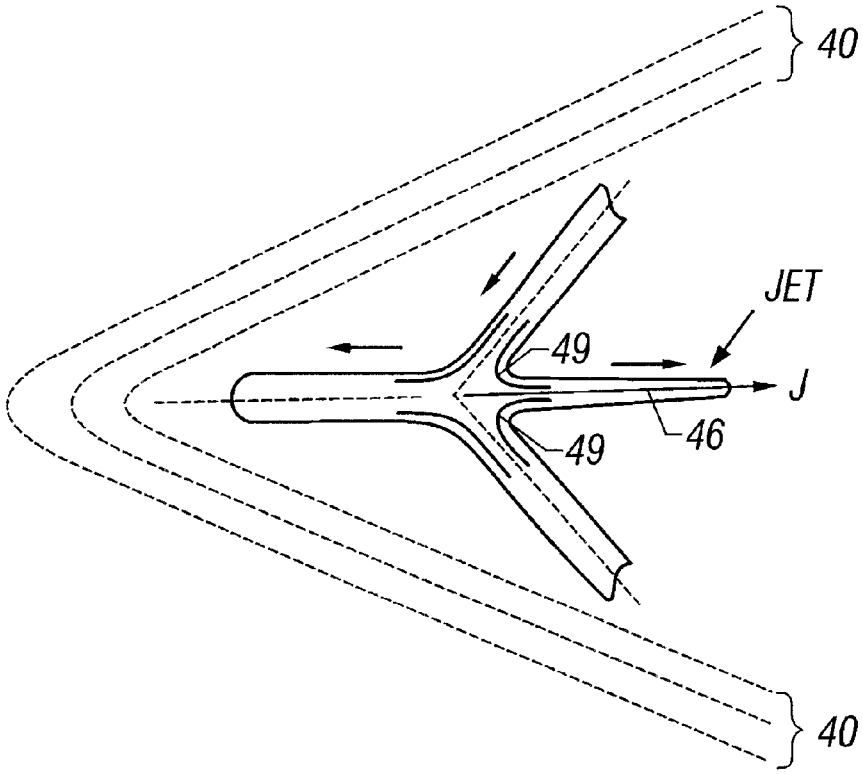
FIG. 2B (Prior Art)
Figure 15A:
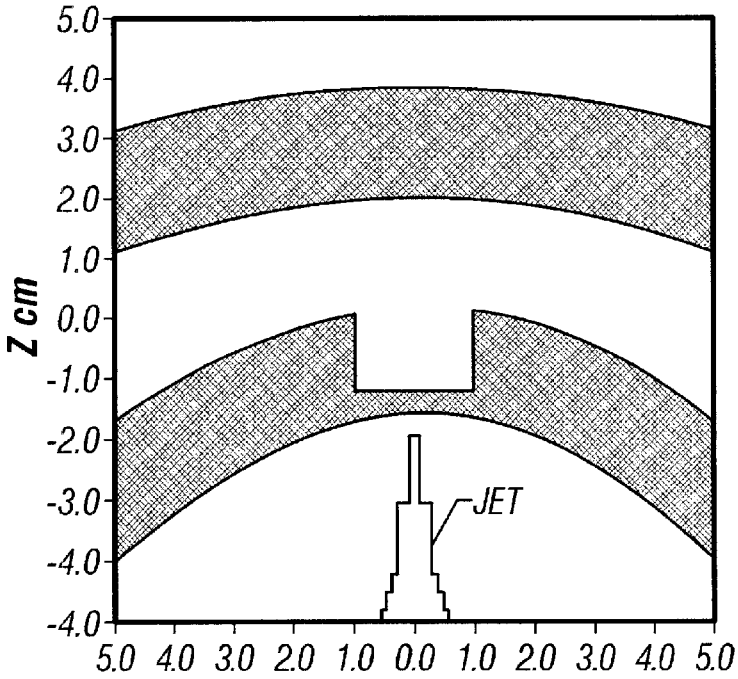
FIGS. 15A–15E illustrate a simulation of a perforating jet extending through a conventional recess according to FIGS. 1B–1C, and compression waves generated at different time points.
Figure 15B:
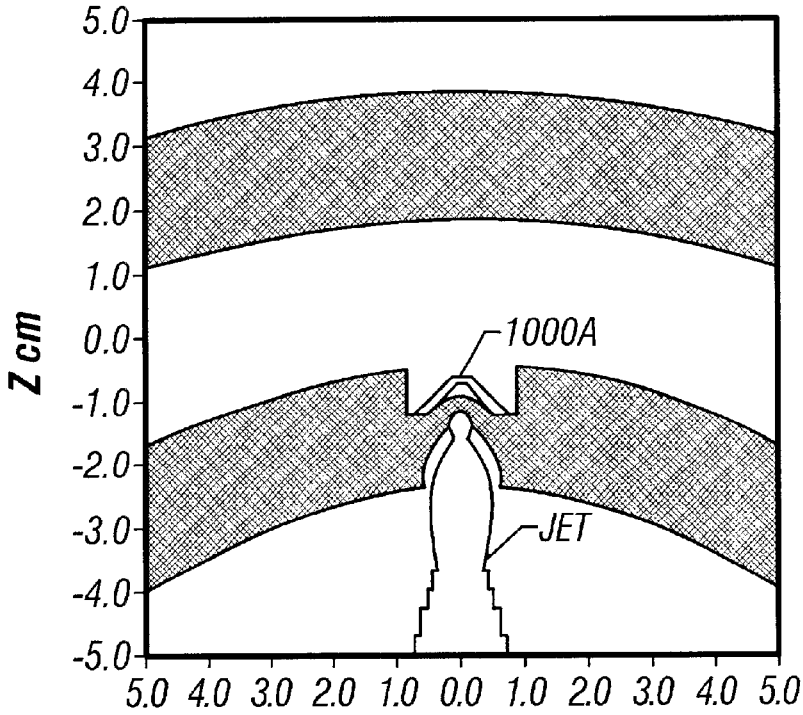
Figure 15C:
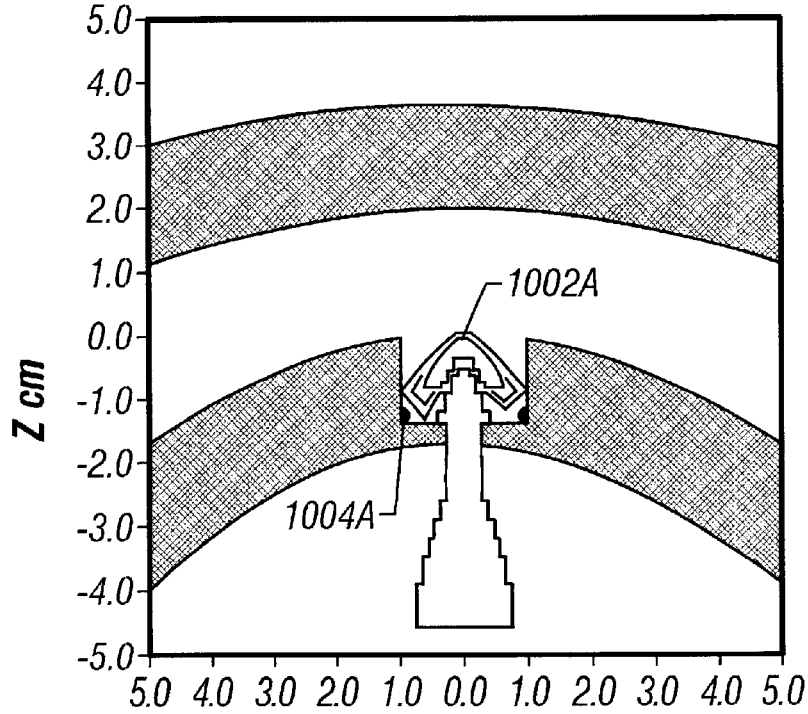
Figure 15D:
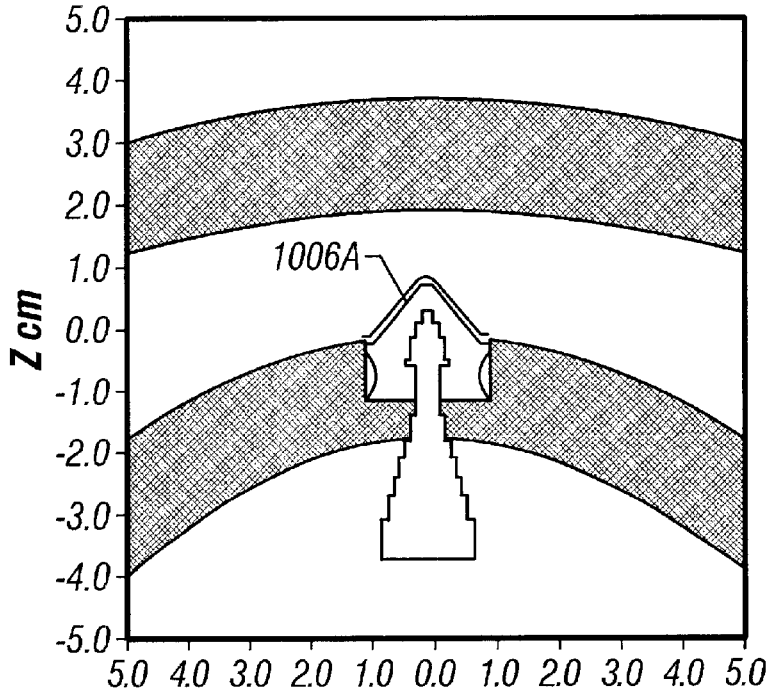
Figure 15E:
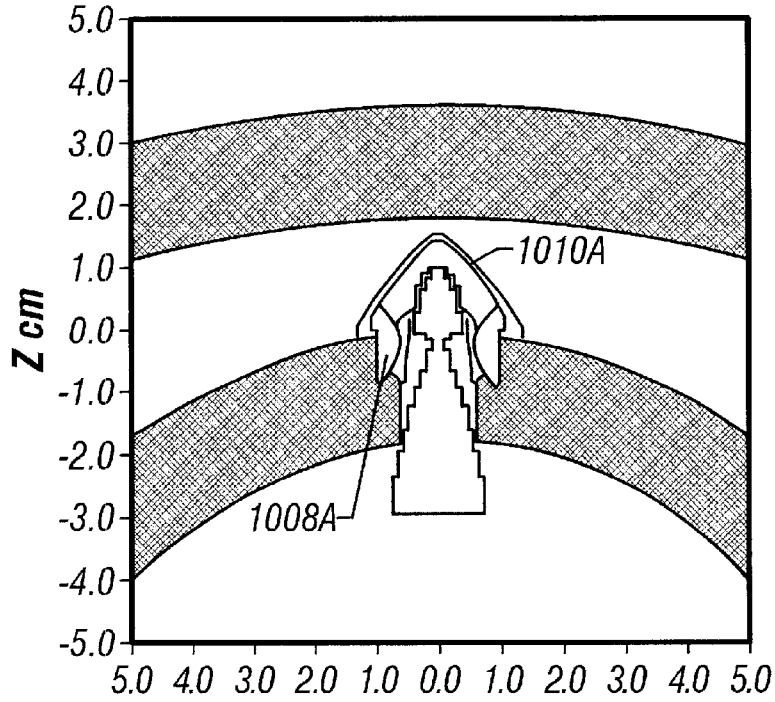
Figure 16A:
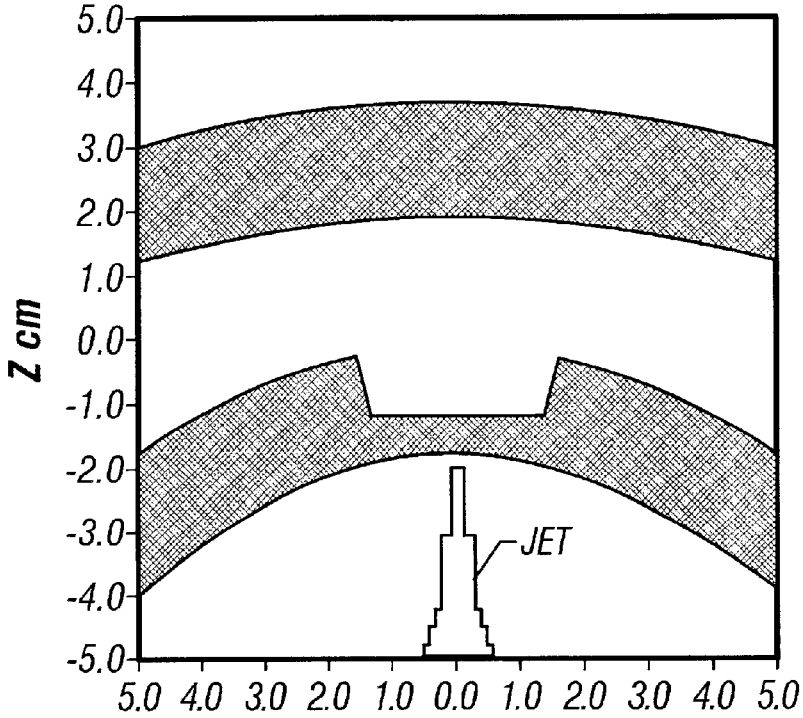
FIGS. 16A–16E illustrate a simulation of a perforating jet extending through a recess according to FIGS. 4A–4B and compression waves generated at different time points.
Figure 16B:
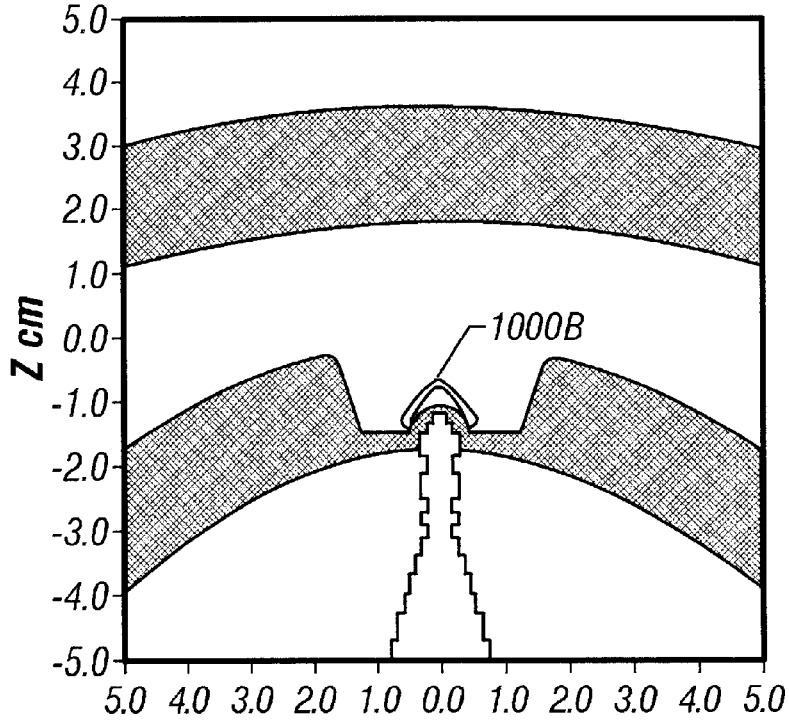

Referring to FIGS. 15A–15E and 16A–16E, simulations of perforating jets extending through a conventional recess according to FIGS. 1B–1C (FIGS. 15A–15E) and through a recess according to FIGS. 4A–4B (FIGS. 16A–16E) and associated compression waves are illustrated. FIGS. 15A and 16A show the perforating jets right at a point before impacting webs of corresponding recesses. FIGS. 15B and 16B show the perforating jets extending through portions of the webs of corresponding recesses, with compression wave fronts 1000A and 1000B generated. Generally, the compression waves closer to the perforating jet have the highest pressure.

Figure 16C:
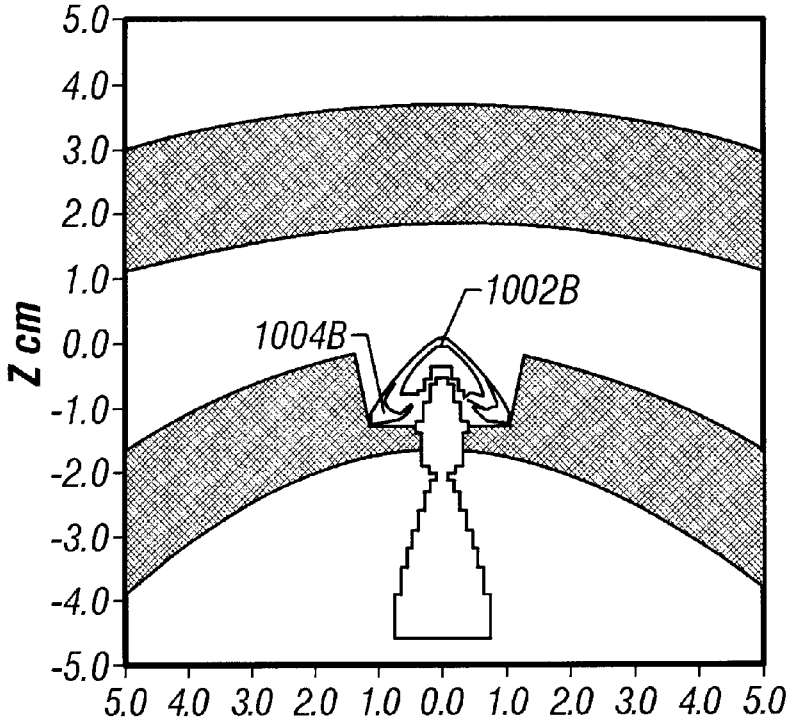

As shown in FIGS. 15C and 16C, the perforating jet tips have extended through the webs of corresponding recesses and are close to extending all the way through the recesses. Portions 1002A and 1002B that are closest to the tips of corresponding jets have the highest pressures, while the wave fronts surrounding portions 1002A and 1002B have lower pressures. However, as shown in FIG. 15C, in the conventional recess with the generally perpendicular side surface, a compression wave portion 1004A constitutes a high pressure reflection from the side surface. In contrast, as shown in FIG. 16C, no such high pressure reflection has yet occurred in the recess according to FIGS. 4A–4B.

Figure 16D:
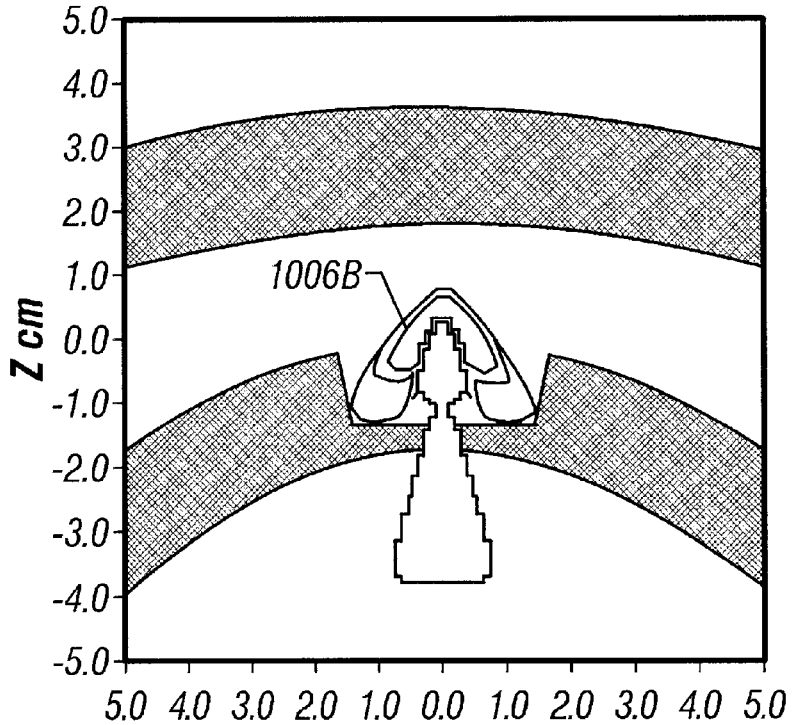
Figure 16E:
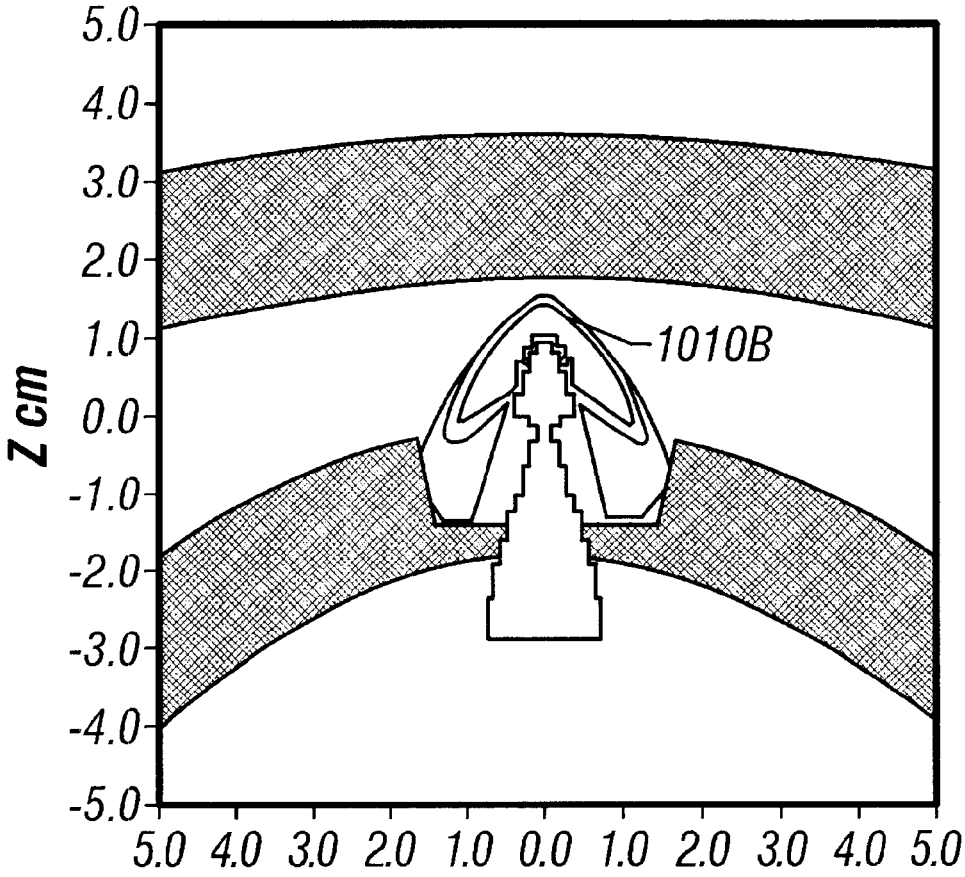

Next, in FIG. 15D, reflections in the conventional recess have created a portion 1006A that includes high pressure compression waves. In contrast, as shown in FIG. 16D, the high pressure compression wave 1006B is still created primarily by the leading edge of the perforating jet. In FIGS. 15E and 16E, a second portion of the perforating jet that is behind the tip has extended almost through the corresponding recesses. In FIG. 15E, two high pressure compression wave portions 1008A and 1010A are illustrated. The compression wave portion 1008A is primarily reflected back from the side surface of the recess and, as illustrated, is about to impact the perforating jet to cause interference. In contrast, as shown in FIG. 16E, the high pressure side reflections are not present in the recess according to FIGS. 4A–4B. Thus, the simulation results illustrate the superior perforating jet performance using the recess according to FIGS. 4A–4B.

Figure 17:
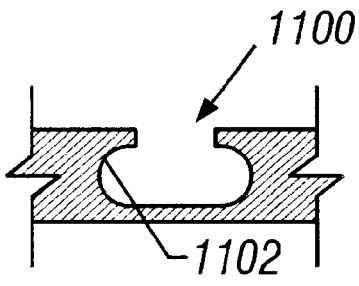
FIGS. 17 and 18 illustrate different embodiments of recesses having inwardly extending side surface portions.
Figure 18:
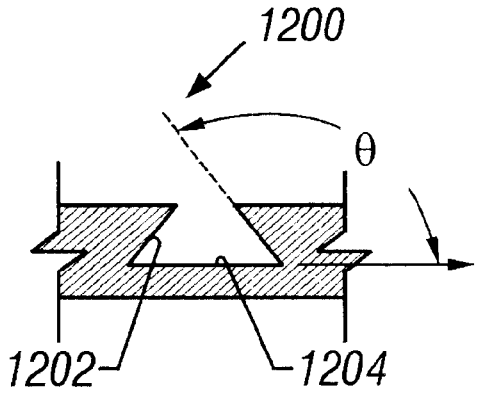

Referring to FIGS. 17 and 18, recesses 1100 and 1200, respectively, according to other embodiments are illustrated. Such recesses have inwardly extending side surfaces that are adapted to focus reflection of compression waves back onto a perforating jet. Such focusing of the reflection reduces the charge performance. In FIG. 17, the side surface 1102 is generally concave with at least a portion that extends inwardly. In FIG. 18, the side surface 1202 is generally planar and extends at an angle θ that is greater than 90° with respect to the axis in the plane of the bottom surface 1204. Such recesses may be advantageously used in a multiphase puncher gun to reduce the depth of penetration. The shape of the recesses may be different (or the same) along the different phases of the puncher gun.

While the invention has been disclosed with respect to a limited number of embodiments, those skilled in the art will appreciate numerous modifications and variations therefrom. It is intended that the appended claims cover all such modifications and variations as fall within the true spirit and scope of the invention.

What is claimed is:

1. A gun carrier comprising:

a housing having a plurality of recesses; and a material placed along a side surface of each recess, the material having shock absorbing characteristics.

2. The gun carrier of claim 1, wherein the material includes one or more inserts.

3. The gun carrier of claim 1, wherein the material is coated to the side surface.

4. The gun carrier of claim 1, wherein the recess further includes a bottom surface, the side surface being generally perpendicular to the bottom surface.

5. The gun carrier of claim 1, wherein the recess further includes a bottom surface, the side surface being slanted with respect to the bottom surface.

6. The gun carrier of claim 1, wherein the insert is generally ring shaped.

7. A carrier for containing explosives for use in a wellbore, comprising:

a housing having a plurality of recesses; and a plurality of caps each sealably covering a corresponding recess to provide a chamber in the recess sealed from wellbore fluids.

8. The carrier of claim 7, further comprising a seal between each cap and a corresponding portion of the housing.

9. The carrier of claim 8, wherein the portion of the housing comprises a shoulder.

10. The carrier of claim 8, wherein the seal is formed of an elastomer material.

11. The carrier of claim 7, wherein each cap is welded to a corresponding portion of the housing.

12. The carrier of claim 7, wherein the sealed chamber is initially filled with a fluid.

13. The carrier of claim 12, wherein the fluid is provided to reduce compression waves generated by a perforating jet passing through the chamber.

14. The carrier of claim 12, wherein the fluid comprises a gas.

15. The carrier of claim 12, wherein the fluid comprises air.

16. The carrier of claim 7, wherein each cap is formed of a material adapted to withstand wellbore pressure but adapted to shatter in response to a perforating jet.

17. A carrier for containing explosives for use in a wellbore, comprising:

a housing having a plurality of recesses;

a plurality of structures positioned in respective recesses, each structure adapted to reduce compression waves generated by a perforating jet.

18. The carrier of claim 17, wherein each structure comprises a material having shock absorbing characteristics.

19. The carrier of claim 18, wherein the material comprises one or more inserts positioned along a side surface of each recess.

20. The carrier of claim 18, wherein the material is coated to a side surface of each recess.

21. The carrier of claim 17, wherein each recess comprises a bottom surface and a side surface extending from the bottom surface to define the recess.

22. The carrier of claim 17, wherein the structures comprise caps sealably engaged to respective portions of the housing to defined a sealed chamber in the recess.

23. The carrier of claim 22, wherein the sealed chamber comprises a fluid.

24. The carrier of claim 23, wherein the fluid comprises gas.

* * * * *